United States Patent [19]

Faller

[11] 4,403,548

[45] Sep. 13, 1983

[54] PRINTING PLATE FOR LINEAR BAR SYMBOL CODE

[75] Inventor: Rudolph A. Faller, Edina, Minn.

[73] Assignee: Champion International Corporation, Stamford, Conn.

[21] Appl. No.: 295,572

[22] Filed: Aug. 24, 1981

Related U.S. Application Data

[63] Continuation of Ser. No. 112,924, Jan. 17, 1980, abandoned.

[51] Int. Cl.[3] ..... B41F 13/00

[52] U.S. Cl. ..... 101/372; 101/376; 101/368; 101/401

[58] Field of Search ..... 235/467, 436; 101/368, 101/272, 327, 328, 375, 376, 329, 401, 379, 415.1

[56] References Cited

U.S. PATENT DOCUMENTS

| | | | |
|---|---|---|---|
| 1,887,382 | 11/1932 | Tupper | 101/415.1 |
| 2,607,293 | 8/1952 | McKay | 101/376 |
| 3,106,891 | 10/1963 | James | 101/376 |
| 3,425,347 | 2/1969 | Nard | 101/376 |
| 4,097,729 | 6/1978 | Seligman et al. | 235/467 |
| 4,183,465 | 1/1980 | Dobras | 101/372 |

*Primary Examiner*—William Pieprz
*Attorney, Agent, or Firm*—Evelyn M. Sommer

[57] ABSTRACT

A printing plate for printing a linear bar symbol code includes a body portion which is adhesively bonded to a mylar mounting sheet that is secured to a typical printing cylinder core. Integral with the body portion of the printing plate is a substantially rectangular frame member having opposed side members and end members which enclose a central channel. Disposed within the channel and integral with and connecting the opposed side members are a plurality of spaced bar members which define the linear bars of a symbol code. One of the side members includes a plurality of recesses having the configuration of numbers disposed in relief. The machine-readable linear bars correspond to the human-readable numbers of a symbol code. The frame member which constitutes a majority of the printing contact surface of the plate is raised the same distance from the body portion as the linear bar members such that the contact surface of the frame is flush with the contact surfaces of the bar members. By this arrangement, the frame member minimizes distortion of the linear bars when contact pressure is applied during a printing operation.

5 Claims, 6 Drawing Figures

5

PRINTING PLATE FOR LINEAR BAR SYMBOL CODE

This is a continuation of application Ser. No. 112,924, filed Jan. 17, 1980, now abandoned.

BACKGROUND OF THE INVENTION

The subject invention relates to an improved printing plate for printing a linear bar symbol code on material, and in particular, a printed plate especially adapted for printing a symbol code on corrugated paperboard material.

In order to expedite the handling and distribution of boxed products, such as food products, packaged goods, etc., a symbol code may be employed and disposed on the shipping container for the products. As an example, usually a corrugated paperboard carton is employed as an outer carrier or container for a plurality of cans of foodstuffs, and to expedite the processing and shipment of the carton of foodstuffs, a symbol code may be printed on the outer corrugated paperboard carton. The symbol code generally encodes eleven information digits which are in human-readable form, and a linear bar arrangement that is encoded in machine-readable form. Usually twelve encoded linear bar characters are provided consisting of eleven informational characters plus one check character. The linear bar encoded characters are boarded by a start pattern on the left side, and by a stop pattern on the right side. Usually a seven-module "light" area precedes the "start" pattern, and also follows the "stop" pattern of the linear bar characters, and furthermore, the linear bar symbol is separated into halves by a central field separator pattern. The latter affords means whereby the linear bar symbols may be machine-read by two scans, each of which covers at least one half of the linear bar code arrangement. The result of those two scans is then processed through suitable "reading" equipment in order to "read" the linear bar portion of the symbol code.

Prior art printing plates for printing a linear bar symbol code are generally made of rubber and have a thickness on the order of 0.250 inches. The prior art printing plate generally includes a plurality of raised, spaced, portions, or bars which, of course, have the dimensions of the desired linear bars of the code for the symbol code to be printed. The printing plate also includes a plurality of raised numerals which print the human-readable digits, and generally the printing plate is mounted on a cylindrical drum. As the drum rotates, the printing plate comes into contact with the carton or container to be printed, and the symbol code is printed thereon.

Prior art printing plates for printing a symbol code have several shortcomings, especially when used in conjunction with containers or cartons made of a corrugated paperboard material. For example, the only part of the printing plate usually coming in contact with the corrugated container to be printed, and thus the part of the plate bearing the full pressure of the drum as the symbol code is being printed, is the relatively thin raised linear bar portions and digits of the printing plate. In practice, it has been found that because the linear bar portions are made of rubber or plastic material, they are compressible, and the compression of the opposite ends of the linear bars gives rise to expansion and distotion of the individual bars, and hence of the overall symbol code. It will be appreciated that distortion of the linear bars or incomplete printing thereof may be critical in that if the correct dimensions of the desired linear code are not accurately reproduced, a non-scan or possibly an incorrect product information scan may result.

The shortcomings of the prior art printing plates may even be more acute when the material upon which the symbol code is to be printed is a corrugated paperboard. More specifically, it has been known that the printing pressure, which is concentrated in the very thin, raised linear portions of the printing plate, and in the digits on the printing plate, may cause a relatively deep impression in the printed material, especially in those regions of the corrugated paperboard wherein the overlay sheets bridge the corrugated intermediate portion of the paperboard. In such case, the resulting impression may be distorted and could result in partial crushing of the paperboard in the region of the distribution symbol code.

Accordingly, it is an object of the subject invention to provide a new and improved printing plate for printing a linear bar distribution symbol code having a more uniform distribution of pressure.

It is a further object of the subject invention to provide a printing plate having the above characteristics in which the degree of distortion after repeated use of the plate is significantly reduced.

It is a further object of the invention to provide a new and improved printing plate having the above characteristics which, when used for printing a symbol code on corrugated paperboard minimizes crush or damage to the paperboard.

SUMMARY OF THE INVENTION

In accordance with the subject invention, a printing plate for printing a linear bar symbol code includes a body member which is flexible and is in the form of a flat flexible sheet adapted to be adhesively bonded to a mylar mounting sheet that is mounted on a typical printing cylinder core. The printing plate further includes a frame member having opposed side members and end members, the side members and end members enclosing a central channel. Preferably, the side members have portions of reduced width such that the channel comprises a central, generally rectangular aperture and a pair of flared end apertures which extend further into the side members than the central aperture. Disposed within the rectangular aperture and integral with and interconnecting the opposed side members of the frame are a plurality of spaced bar members, which correspond in width and spacing to the width and spacing of the linear bar portion of the symbol code to be printed. In addition, one of the side members includes a plurality of recesses having the configuration of digits or numbers that are disposed in relief in the side member of the frame. The linear bar code portion of the symbol code corresponds to the digits or numbers of the symbol code. Both of the frame member and the linear bar members are raised from the plate body portion to approximately the same distance such that the printing contact surface of the frame is flush with the printing contact surface of the linear bar members and the numerals disposed in relief. In addition, it is preferable that the frame constitutes a major portion of the printing contact area of the plate.

DESCRIPTION OF THE PREFERRED EMBODIMENT

Figure 1:
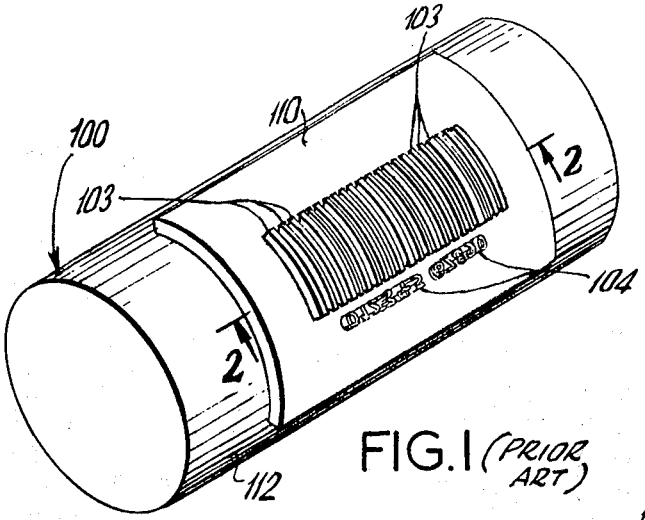
FIG.1 (PRIOR ART)
FIG. 1 is a perspective view of a prior art printing plate which is mounted on a printing cylinder core.
Figure 2:
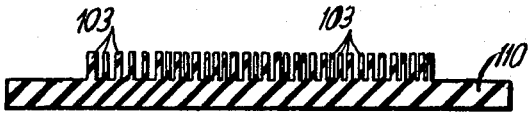
(PRIOR ART) FIG.2
FIG. 2 is a partial cross-sectional view of the prior art printing plate illustrated in FIG. 1 taken along line 2—2 of FIG. 1.

Referring to FIGS. 1 and 2, there is illustrated a typical printing cylinder 100 to which is fixed a mylar mounting sheet 112. A printing plate 110 that is flexible and conforms to the cylinder is adhesively bonded to the mylar sheet 112. The printing plate 110 includes a series of spaced, parallel, raised linear bar members 103 which correspond in size and spacing to that of the lines of the desired symbol code. The flexible plate 110 also includes a series of raised numerals 104 extending along an edge of the raised bar members, the raised numerals corresponding to the code numbers, each of which is duplicated by the linear bar code lines. The code infomation may include manufacturer's name, particular product, size, etc.

As will be appreciated from FIGS. 1 and 2, the only portions of plate 110 which come into contact with the material to be printed are the thin raised bar portions 103 and numeral portions 104. Accordingly, all of the impression pressure of the cylinder and plate contact with the material to be printed is borne by the thin raised portions, thereby resulting in distortion of the symbol code.

Figure 3:
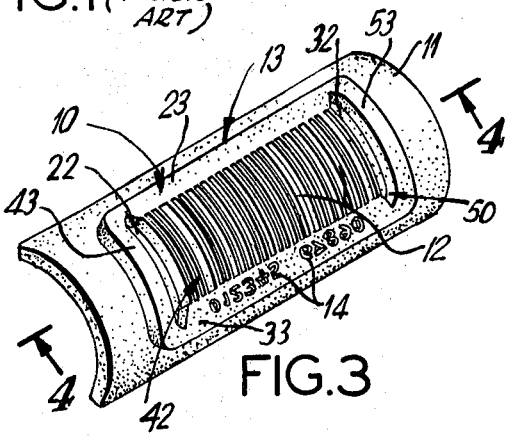
FIG. 3 is a perspective view of the printing plate of the subject invention.
Figure 4:
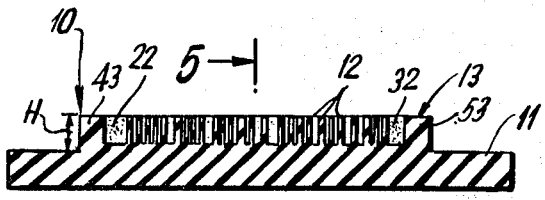
FIG. 4 is a cross-sectional view of the printing plate of the subject invention taken along line 4—4 of FIG. 3.
Figure 5:
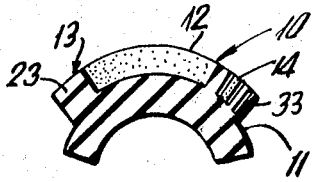
FIG. 5 is a cross-sectional view of the printing plate of the subject invention taken along line 5—5 of FIG. 4.

Referring to FIGS. 3 through 5, there is illustrated a printing plate 10 of the subject invention which is made of a compressible material, such as a plastic material, a natural or synthetic rubber, or other suitable compressible material. The plate 10 includes body portion 11 which is adapted to be adhesively bonded to a mylar mounting sheet (not shown) for securing the body portion to a printing cylinder (not shown). The plate 10 further includes frame member 13 that is of generally rectangular configuration and is raised a distance H from body portion 11. Frame 13 includes opposed parallel side portions 23 and 33, and opposed parallel end portions 43 and 53, said side and end portions being disposed around a channel or aperture 50. Preferably, side members 23 and 33 have portions of reduced width such that channel 50 comprises a central, generally rectangular aperture 42 and two end apertures 22 and 32 which are flared and extend further into side portions 23 and 33 than central aperture 42. In addition, side member 33 includes a plurality of recesses 14 which have the configuration of recessed digits or numbers. Recesses 14 of course correspond to the numbers associated with the particular information segments of the linear symbol code.

Disposed within aperture 42, and connecting side members 23 and 33 are a plurality of parallel, spaced bar members 12, said bar members corresponding in width and spacing to the width and spacing of the linear bars of the distribution symbol code. Thus, it will be seen that end members 43 and 53 of frame 13 are spaced away from bar members 12 by flared apertures 22 and 32 respectively. It should be noted that like frame member 13, bar members 12 are raised relative to the base of the cylindrical body portion 11 such that the top surfaces or printing contact surfaces of the frame and bar members are flush (see FIGS. 4 and 5). In addition, it is preferable that side members 23 and 33, and end members 43 and 53 constitute a majority of the printing contact surface of the subject plate.

Figure 6:
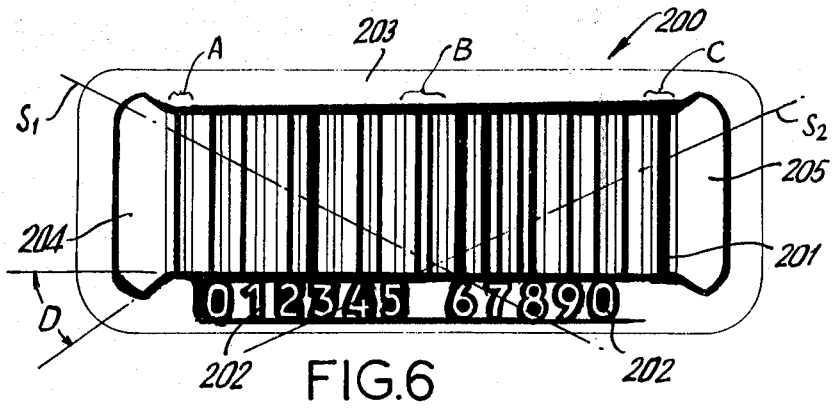
FIG. 6 is a plan view of a symbol code printed utilizing the subject printing plate, and also illustrating the paths of two machine-readable scan lines.

Referring to FIG. 6, there is illustrated the linear bar symbol code which has been printed with the printing plate of the subject invention. The frame member 13 and bar members 12 of the subject printing plate are inked and produce a linear bar code 201 which appears in a dark border 203, which of course correspond in configuration to that of the frame member. In addition, because the code numbers exist as recesses 14 in the frame 13 of the subject plate, the numbers 202 printed appear white (uninked) surrounded by a dark border. The first and last lines of the line code are spaced away from border 203 by uninked portions 204 and 205 which correspond in configuration to flared apertures 22 and 32, respectively, of frame member 13. It should be noted that as illustrated in FIG. 6, the border portion 203 of the symbol code is only partly darkened. In reality, however, the entire border portion 203 is dark.

The left hand side of the resulting symbol code, designated by the letter "A" is a linear bar arrangement showing the "start" pattern for the machine readable linear bars. The right-hand portion, designated by the letter "C" is a "stop" pattern, and on both sides of the linear bar code at points 204 and 205 there is a seven-module "light" area. The linear bar symbol is separated into halves by a field separating pattern, designated by the letter "B". The machine-readable representation of each digit is a specific arrangement of three light spaces and three dark bars. The machine-readable representation of each digit corresponds to the digits 202.

The flared apertures 22 and 32 of the printing plate results in the ends of each aperture being angled at an appropriate angle designated "D". The angle "D" is sufficient to enable the resulting symbol code to be scanned by two angled half-scans designed $S_1$ and $S_2$. The angles D must be sufficient in order to enable the angled scans $S_1$ and $S_2$ to cover at least one half of the linear bar code 201 including the field separation pattern B.

Because of the printing contact surface of the frame member 13 is flush with the printing contact surfaces of the linear bar members, and because the frame constitutes a major portion of the printing contact surface of the subject printing plate, uniform distribution of the impression pressure is achieved, even when the printing plate is employed for printing a symbol code on a corrugated paperboard member. Thus, there is minimum variation in image gain in the line code, and in addition the linear bar members of the printing plate do not deeply penetrate the material being printed. Thus, damage to the printing material, especially corrugated paperboard material, is substantially eliminated. Furthermore, because the printing frame of the subject printing plate absorbs much of the pressure, and because it is the frame that now forms the leading and trailing contact edges of the subject printing plate (instead of the thin linear bar members as in the prior art), distortion to the linear bar members, especially at the opposite edges thereof, is substantially eliminated. Furthermore, because of the relatively thick border of the frame member 13, the numerals or digits 14 may be disposed in relief within one side member thereof, and the opposite side member may, if desired, be employed to accommodate other forms of a human-readable recessed information.

While a preferred embodiment of the subject invention has been described and illustrated, it will be obvious that various changes and modifications can be made therein without departing from the spirit of the invention which should be limited only by the scope of the appended claims. For example, although the invention has been described with reference to a specific type of linear bar distribution code, it may readily be adopted to any type of linear bar code which must be reduced to a printing plate for printing on corrugated board material.

What is claimed is:

1. A printing plate for printing a symbol code on a corrugated paperboard material comprising:

a body portion;

a series of raised, spaced parallel bar members integral with said body portion, said bar members corresponding in size and spacing to the size and spacing of the linear bars of the symbol code and including an approximately centrally located field separation pattern to enable two half-scans of the code; and a continuous substantially rectangular peripheral frame member integral with said body portion and disposed entirely around said bar members, said frame including opposed pairs of end and side members, said end members of said frame being generally parallel to and spaced away from the longitudinal edges of the first and last bar members in the series, the side members of said frame being unitary with and generally perpendicular to the opposite end edges of each said bar member, said side members and end members of said frame enclosing a central channel for receiving the bar members, said side members having portions of reduced width adjacent each said end member such that the central channel enclosed by said side members and end members comprises a central, substantially rectangular aperture for receiving the bar members and a pair of end apertures flared outwardly from said rectangular aperture a sufficient amount to enable the symbol code to be scanned by two angled half-scans, with each said half-scan incorporating at least one-half of said symbol code plus the field separation pattern, said frame being raised from the surface of the body portion the same distance as the bar members such that the printing contact surface of said frame member is flush with the printing contact surfaces of the bar members, said frame member constituting the major portion of the printing contact surface of the printing plate.

2. A printing plate for printing a symbol code as recited in claim 1 wherein said frame member includes a plurality of recesses having the configuration of numbers.

3. A printing plate for a symbol code as recited in claim 2 wherein the recesses having the configuration of numbers are disposed in one of the side members of the frame member.

4. A printing plate for a symbol code as recited in claim 1 wherein the unitary frame member and the bar members are made of a deformable rubber material.

5. A printing plate for a symbol code as recited in claim 1 wherein the unitary frame member and the bar members are made of a deformable plastic material.

* * * * *